US009128414B2

(12) United States Patent
Shanun et al.

(10) Patent No.: US 9,128,414 B2
(45) Date of Patent: Sep. 8, 2015

(54) SEAL

(71) Applicant: Clover Technologies Group, LLC, Ottawa, IL (US)

(72) Inventors: Sagie Shanun, Valley Village, CA (US); Alexander Krayner, Los Angeles, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 14/214,540

(22) Filed: Mar. 14, 2014

(65) Prior Publication Data

US 2014/0265159 A1 Sep. 18, 2014

Related U.S. Application Data

(60) Provisional application No. 61/785,635, filed on Mar. 14, 2013.

(51) Int. Cl.
*G03G 15/08* (2006.01)

(52) U.S. Cl.
CPC ..... *G03G 15/0882* (2013.01)

(58) Field of Classification Search
USPC ..... 399/102, 103, 105, 106
See application file for complete search history.

(56) References Cited

U.S. PATENT DOCUMENTS

| | | | | |
|---|---|---|---|---|
| 5,027,156 | A | 6/1991 | Kobayashi | |
| 5,223,068 | A | 6/1993 | Baley | |
| 6,350,503 | B1 | 2/2002 | Cheatham et al. | |
| 6,577,830 | B1 | 6/2003 | Wazana et al. | |
| 6,801,733 | B2 | 10/2004 | Daniels et al. | |
| 6,842,595 | B1 | 1/2005 | McIver et al. | |
| 7,175,725 | B2 | 2/2007 | Chitouras | |
| 7,177,565 | B1 | 2/2007 | Miller | |
| 7,212,765 | B2 | 5/2007 | Lewis et al. | |
| 7,333,747 | B2 | 2/2008 | Jones et al. | |
| 7,693,448 | B1 | 4/2010 | Lenahan | |
| 7,903,996 | B2 | 3/2011 | Lenahan | |
| 8,005,395 | B2 | 8/2011 | Lewis et al. | |
| 2003/0170045 | A1 | 9/2003 | Lewis et al. | |
| 2003/0205311 | A1 | 11/2003 | Chitouras | |
| 2004/0156650 | A1 | 8/2004 | Ziegelmuller et al. | |
| 2006/0133848 | A1* | 6/2006 | Lewis et al. | 399/106 |
| 2006/0198656 | A1 | 9/2006 | Lewis et al. | |

FOREIGN PATENT DOCUMENTS

| | | |
|---|---|---|
| JP | 59053868 | 3/1984 |

* cited by examiner

*Primary Examiner* — Clayton E Laballe
*Assistant Examiner* — Jas Sanghera

(57) ABSTRACT

A gasket seal is disclosed. The gasket seal containing a gasket defining an opening containing a first gasket longitudinal edge, a second gasket longitudinal edge, a gasket transverse edge, wherein the gasket transverse edge forms a 90 degree angle with the first gasket longitudinal edge and the second gasket longitudinal edge, a seal strip containing a first seal longitudinal edge, a second seal longitudinal edge, and a seal transverse edge, wherein the seal transverse edge forms an acute angle with the first seal longitudinal edge wherein the seal transverse edge forms an obtuse angle with the second seal longitudinal edge, wherein the seal strip is removably coupled with the gasket.

6 Claims, 18 Drawing Sheets

PRIOR ART

PRIOR ART

PRIOR ART

SEAL

CROSS REFERENCE TO RELATED APPLICATIONS

This application is related to U.S. Pat. No. 7,693,448, filed on Jun. 5, 2009 and granted on Apr. 6, 2010, which is incorporated herein by reference in its entirety. This application is related to U.S. Pat. No. 7,903,996, filed on Mar. 10, 2010 and granted on Mar. 8, 2011, which is incorporated herein by reference in its entirety. This application claims the benefit of U.S. Provisional Application No. 61/785,635, filed on Mar. 14, 2013, which is incorporated herein by reference in its entirety.

FIELD

The present invention relates generally to the field of toner cartridges.

BACKGROUND

One problem with aftermarket laser printer toner cartridges sometimes occurs as the aftermarket cartridge is installed in the printer and made ready for printing by removing a strip seal that retains toner inside of the cartridge hopper during transportation from the manufacturer to the end user. The general problem is that the seal can jam and when it is jammed, it will not pull out of the cartridge. This seal, also known as the hopper gasket pull seal, has as its only purpose the sealing of the opening of the hopper tank for transporting to the end user without leaking toner into the shipping container. Once the seal is pulled out of the cartridge by the end user, the opening at the top of the toner hopper tank is uncovered, thus allowing toner to be transferred to the other components of the laser cartridge for printing.

An original equipment manufactured (OEM) cartridge will typically not have a jamming problem because the pull seal is directly adhered to the toner hopper tank in the OEM manufacturing process. However, in rebuilding or remanufacturing aftermarket toner cartridges, the hopper tank is split into two sections, and then, during the remanufacturing process, the two sections are pressed and held together, typically by welding, or by a manual means, such as by clips, as described in U.S. Pat. No. 6,577,830 which is incorporated herein by reference in its entirety. During the remanufacturing process the laser printer toner cartridge is cleaned and re-assembled, with new components and new toner charged into the hopper tank. As is known, the resulting remanufactured cartridge can have slight differences in dimensions as related to OEM specifications, and differences exist in aftermarket toner cartridge hopper tank gasket seals and pull strips. To account for some of these differences and in order to maintain a good seal at the toner cartridge hopper opening, a remanufactured toner cartridge may incorporate a gasket seal, and the hopper tank gasket seal may be made from foam, so that a good seal of the hopper can be formed by the gasket and the pull strip. Once the remanufactured cartridge has been sent to an end user and is installed in the printer, ready for use, the pull strip is pulled off of the gasket and out of the toner cartridge to activate the laser toner cartridge for printing. This pulling of the pull seal is when there is a chance that the hopper pull strip will not always release from the hopper tank gasket seal as planned.

It has been discovered that in many instances the reason the hopper tank gasket pull strip does not release from the gasket and thus causes jamming, is due to mechanical reasons. One of the most common reasons for jamming is that the foam gasket is pulled up along with the pull strip and then the gasket and/or the pull strip jam the pull strip exit slot as the pull strip is being pulled out of the laser printer toner cartridge. Another common reason is that "post test toner" that remains after testing the re-manufactured cartridge upon assembly in the factory, curls up with the pull strip as the pull strip is moving along toward the exit slot, and forms a roll or plug of toner that causes jamming at the pull seal exit slot. As this excess toner curls up it forms into a log shape on the top of the pull strip, and it will then lock up along with the pull seal at the beginning of the pull seal exit slot, thus preventing any further pulling of the pull strip and causing the cartridge to be unusable. This phenomenon is known in the industry as the "cigar effect", due to the fact that the excess toner literally looks like a tiny cigar when is it is curled up and is at the pull seal exit slot. The cigar effect causes jamming due to a lack of clearance through the exit slot. In this situation the diameter of the combined cigar shaped toner plug and the surrounding pull seal strip is greater than the width of the pull seal exit slot. As a result the pull seal strip cannot be pulled through the slot and removed from the cartridge.

In view of this, a need exists for a device and/or method to reduce the jamming of the pull strip.

SUMMARY

In some aspects, a gasket seal is provided and includes a gasket defining an opening, and a seal strip removably coupled with the gasket. The seal strip includes a fixed end secured to the gasket, a free end opposite the fixed end and being pulled during removal of the seal strip, a first seal longitudinal edge, a second seal longitudinal edge, a first seal transverse edge adjacent the fixed end and forming an obtuse angle with the first seal longitudinal edge, and a second seal transverse edge adjacent the fixed end and forming another obtuse angle with the second seal longitudinal edge.

In other aspects, a gasket seal is provided and includes a gasket defining an opening and comprising a first gasket longitudinal edge, a second gasket longitudinal edge, a gasket transverse edge that forms a 90 degree angle with the first gasket longitudinal edge and that also forms a 90 degree angle with the second gasket longitudinal edge. The gasket seal also includes a seal strip that includes a first seal longitudinal edge, a second seal longitudinal edge, and a seal transverse edge. The seal transverse edge forms a 90 degree angle with the first longitudinal edge and also forms a 90 degree angle with the second seal longitudinal edge. A gasket sealing border removably adheres the seal strip with the gasket. The gasket sealing border extends substantially around the gasket opening and adheres the seal transverse edge to the gasket adjacent to a gasket exit port end. The gasket sealing border forms a first border longitudinal edge, a second border longitudinal edge, and a border transverse edge. The border transverse edge forms an acute angle with the first border longitudinal edge, and forms an obtuse angle with the second border longitudinal edge.

In still other aspects, a gasket seal is provided and includes a gasket that defines an opening and includes a first gasket longitudinal edge, a second gasket longitudinal edge, a gasket transverse edge that forms a 90 degree angle with the first gasket longitudinal edge and also with the second gasket longitudinal edge. The gasket seal also includes a seal strip comprising a first seal longitudinal edge, a second seal longitudinal edge, and a seal transverse edge. The seal transverse edge forms a 90 degree angle with the first seal longitudinal edge and also forms a 90 degree angle with the second seal longitudinal edge. A gasket sealing border removably adheres the seal strip with the gasket, and the gasket sealing border extends substantially around the gasket opening and adheres the seal transverse edge to the gasket adjacent to a gasket exit port end. The gasket sealing border forms a first border longitudinal edge, a second border longitudinal edge, and a border transverse edge. The border transverse edge forms an obtuse angle with the first border longitudinal edge, and forms another obtuse angle with the second border longitudinal edge.

In the following description, like reference numbers are used to identify like elements. Furthermore, the drawings are intended to illustrate major features of embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
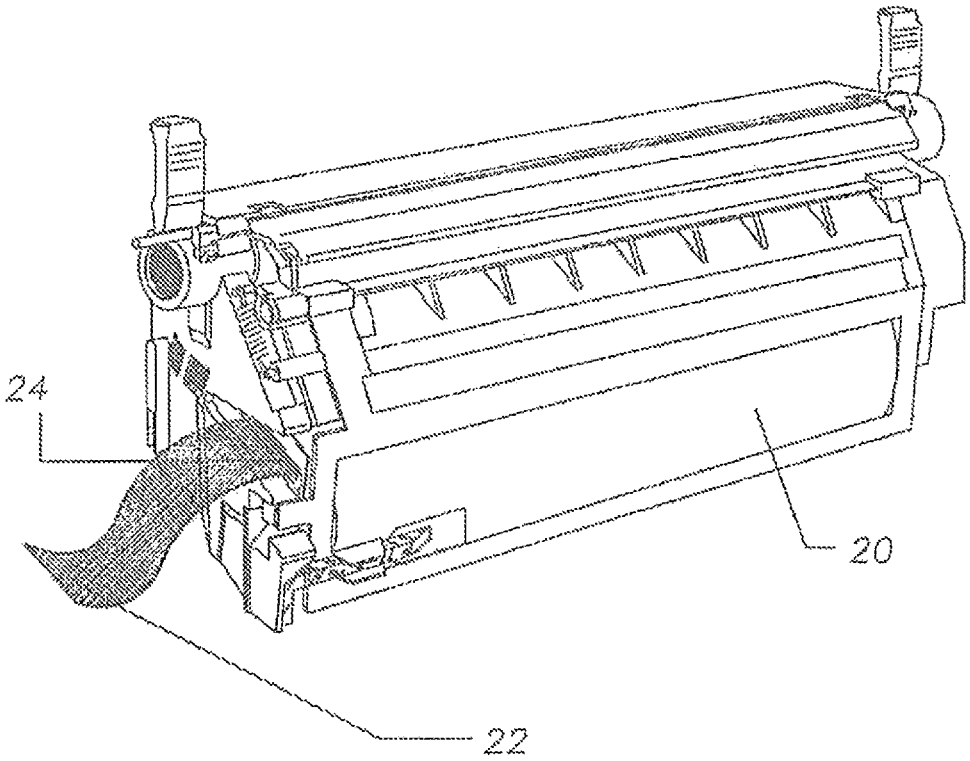
FIG. 1 depicts a perspective view of a conventional remanufactured toner cartridge.

FIG. 1 depicts a typical, conventional laser printer toner cartridge 20, as its toner hopper pull seal strip 22 is partially pulled out of the cartridge 20 for operation. The pull seal strip 22 exits at the end of the cartridge that has cartridge exit slot 24. Pulling the pull seal strip 22 out of the cartridge allows toner to be released from the toner hopper tank, as known in the art.

Figure 2:
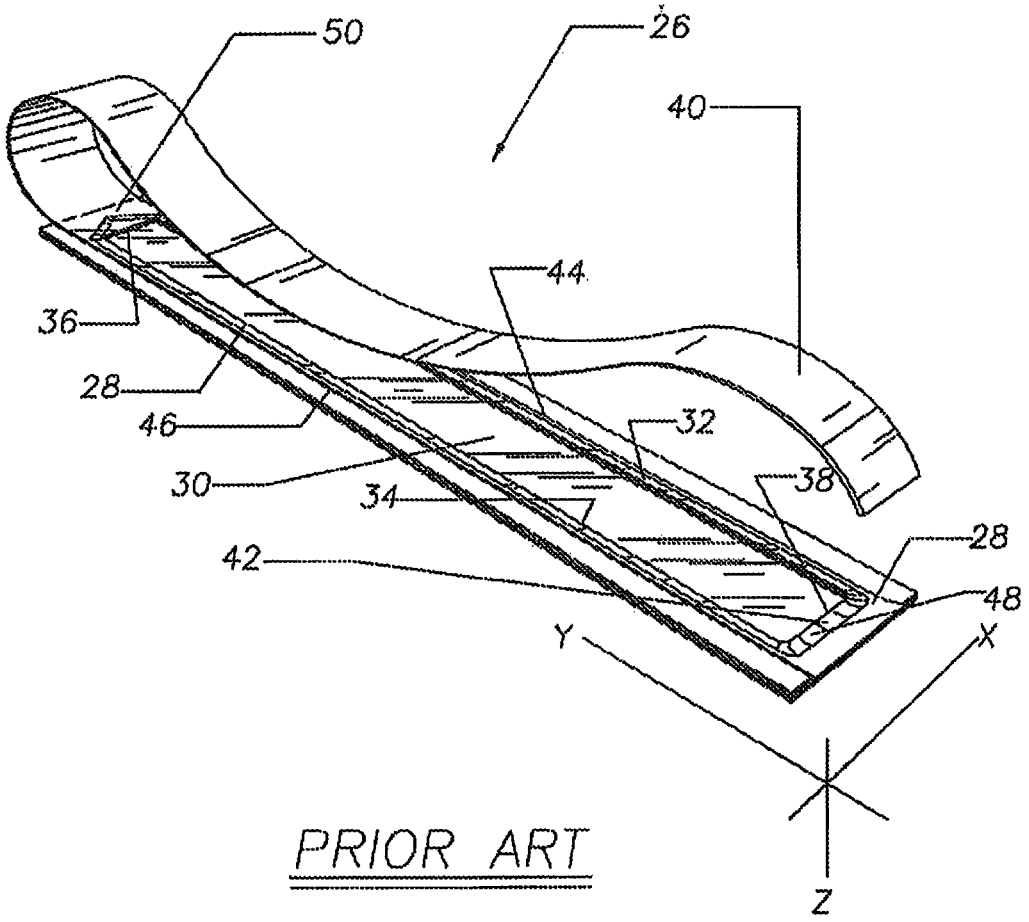
FIG. 2 depicts a perspective view of a gasket seal known in the art.

FIG. 2 depicts a conventional rectangular shaped pull seal 26 used for remanufactured toner cartridges. Seal 26 may comprise a foam gasket 28 that has a rectangular outer periphery and a rectangular inner periphery with an opening 30 in its center, to permit transport of toner from the hopper to the cartridge roller section during printing operations. With reference to the axis shown in FIG. 2, the gasket 28 length extends in a longitudinal direction Y, its width extends in transverse direction X and it has a thickness extending in direction Z. The inner peripheral edges are shown as first longitudinal edge 32, second longitudinal edge 34, first transverse edge 36 and second transverse edge 38. The four inner peripheral edges are at right angles at their joining corners. Overlying the gasket 28 is pull seal strip 40, made of, for example, a polyester film or metalized polyester film, often referred to as Mylar film. One end 42 of the seal 26 is near the toner cartridge pull seal exit port or slot. The pull strip 40 is hot melted to the foam gasket 28 at or near the inner periphery of the gasket, with a first longitudinal hot melt border shown at 44 and a second longitudinal hot melt border shown at 46. At the end 42 of the gasket hot melt border 48 is shown. At the end of the gasket opposite the cartridge pull seal exit port the pull seal is hot melted in the form of a relatively blunt point or arrowhead, as shown at 50 in FIG. 2. The hot melt adheres the pull strip to the gasket, forms a sealing border around the rectangular opening in the gasket and functions to seal the toner inside of the hopper during transport from the manufacturer to the end user. The hot melt border at the end 42 of the gasket has a shape generally conforming to the right angled edges of the inner periphery of the gasket. At the opposite end of the seal, the pointed hot melt pattern 50 facilitates the initial tearing away of the pull seal strip 40 from the gasket 28. The pull seal strip 40 is shown folded over on itself, in a position to be pulled.

Figure 3:
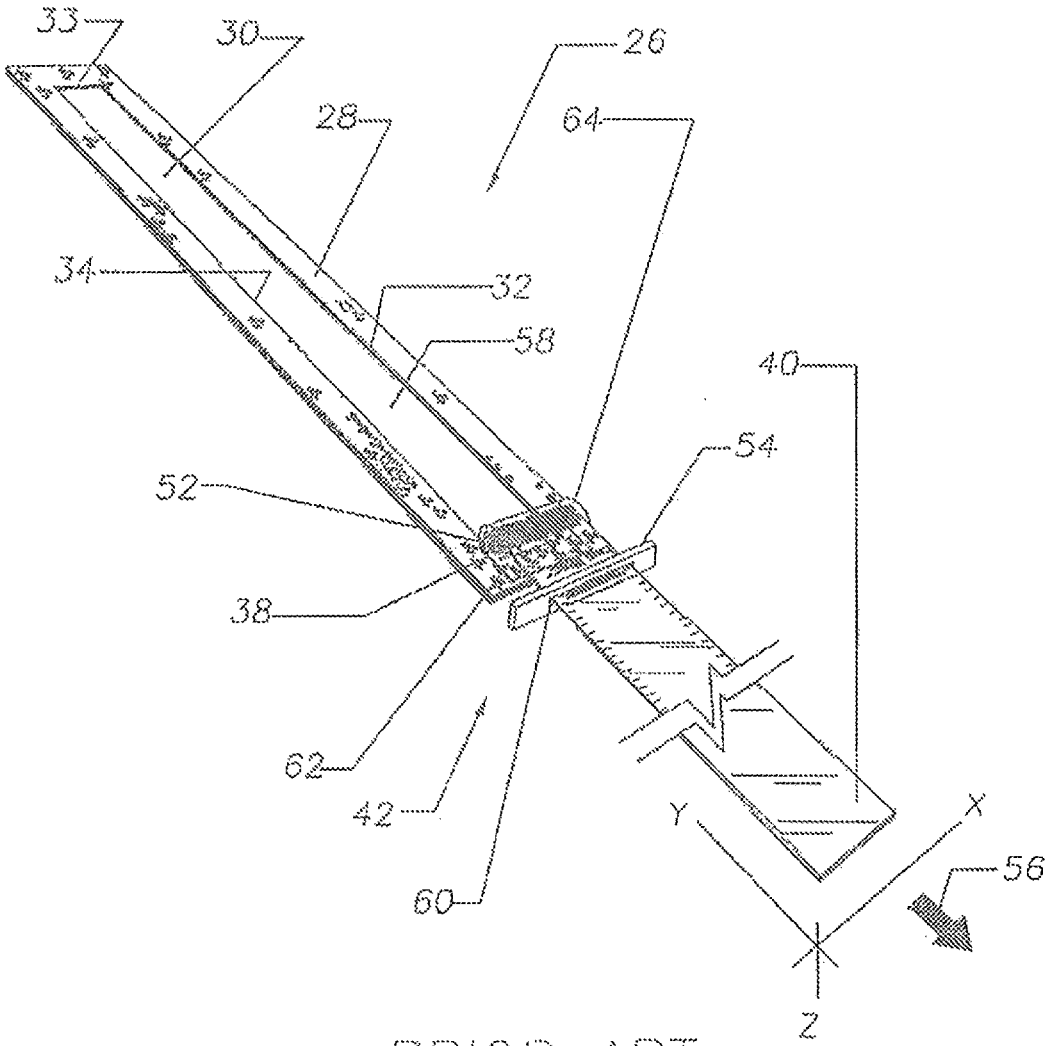
FIG. 3 depicts a perspective view of the gasket seal of FIG. 2 showing a roll of toner blocking removal of the pull strip from the cartridge.

Referring to FIG. 3, conventional seal 26 of FIG. 2 is shown at a point during removal of the pull seal strip 40 when the pull seal strip 40 has been almost completely pulled out of the cartridge, about to be jammed due to the presence of the cigar effect, i.e., a tiny roll of toner 52 that has formed on the top surface of the pull seal strip 40 as its unattached end is pulled out of the cartridge through the exit port 54 in the direction of arrow 56. In this instance jamming occurs due to the roll of toner 52 that prevents the pull seal strip 40 from exiting the cartridge through the seal strip exit port 54. The purpose of the seal strip exit port 54 is to keep the toner cartridge sealed after the toner hopper pull seal 40 has been peeled away from the toner hopper foam gasket 28. While the toner cartridge is in use inside of the printer, toner will be drawn from the toner hopper 20 through the opening shown at 30 of the foam gasket 28 and eventually to the paper from the laser printer. This opening at the interface of the hopper section and the roller section of the cartridge must remain sealed in order to prevent toner from leaking out of the cartridge.

The seal strip exit port 54 has a slot 60 that in turn has enough clearance to allow the pull strip 40, usually 2 to 5 mils in thickness to be removed by pulling it in the direction shown by arrow 56. As shown in FIG. 3, excess toner from the post testing that has developed into the roll or cigar shape 52, inside of the pull strip 40, will not be able to pass through the exit seal port slot 60. The pull seal 40 will jam at the opening or slot of the exit port 54, thus making the toner cartridge defective. As shown in FIG. 3, the cigar shaped roll 52 of the toner has built up at the right-angled corners where the first and second longitudinal edges 32, 34 meet the second transverse edge 38 of the conventional gasket 28, adjacent the hot seal border shown at 62. The thickness of this roll, together with the thickness of the two layers of pull seal 40 at location 64 has a combined thickness sufficient to jam at the opening 60 of the exit port 54.

Figure 4B:
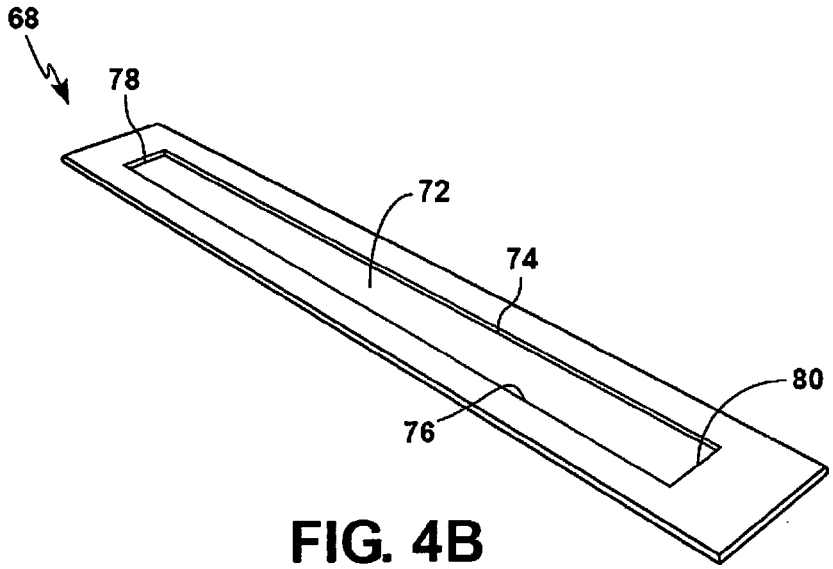
FIGS. 4 *a-c* depict an embodiment of a gasket seal according to the present disclosure.
Figure 4A:
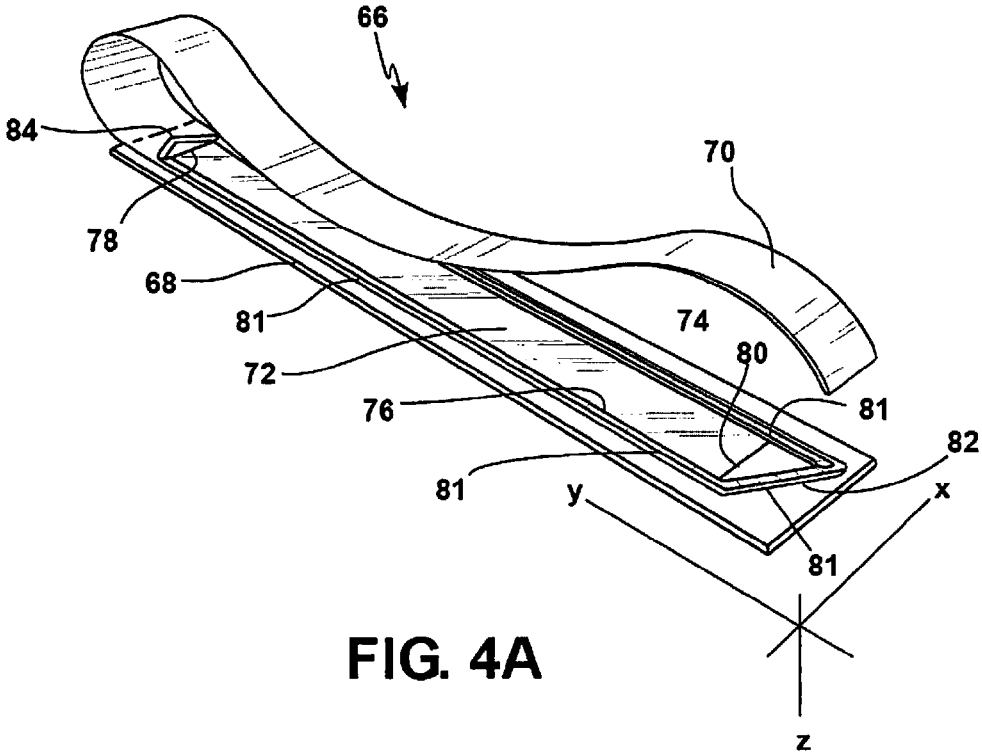
Figure 4C:
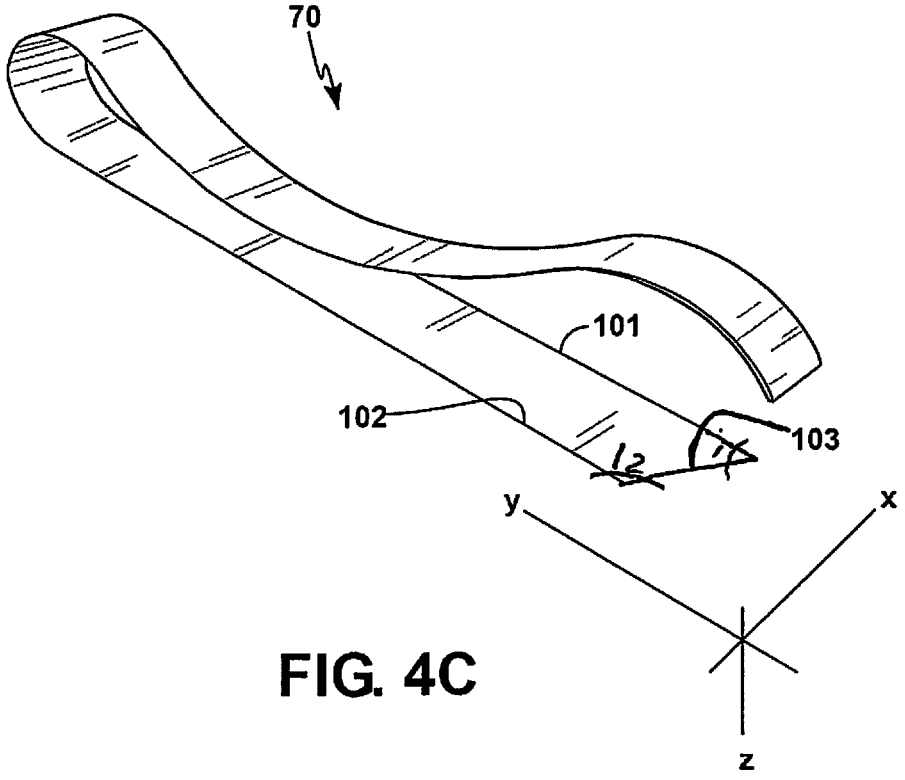
Figure 5:
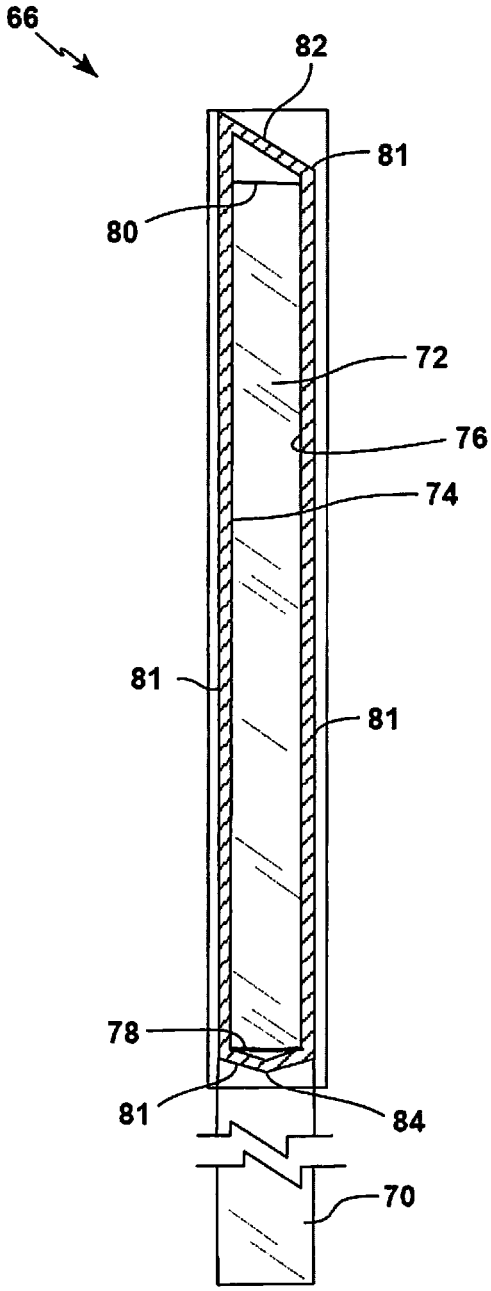
FIG. 5 depicts a top view of the embodiment shown in FIGS. 4 *a-c*.

FIGS. 4 *a-c* depict a perspective view of a gasket seal 66 according to an embodiment presently disclosed. The gasket seal 66 may comprise a gasket 68 (shown in FIGS. 4 *a-b*) and a pull seal strip 70 (shown in FIGS. 4 *a* and 4 *c*). In one embodiment, the gasket 68 may comprise foam material. The gasket 68 may define a substantially rectangular opening 72 (shown in FIGS. 4 *a-b*) to permit through flow of toner during printer operation. Gasket 68's sides or edges of the inner periphery include a first longitudinal edge 74, a second longitudinal edge 76, a first transverse edge 78 and a second transverse edge 80. The angles formed by the longitudinal edges 74 and 76 of the inner periphery with the second transverse edge 80 may be about 90 degrees. The pull seal strip 70 may comprise a first longitudinal edge 101, a second longitudinal edge 102, and a transverse edge 103. In one embodiment, the pull seal strip 70 may comprise a polyester film or metalized polyester film, often referred to as Mylar film.

In one embodiment, an angle 1 formed by the first longitudinal edge 101 with the transverse edge 103 may be an acute angle (an angle that is less than 90 degrees). While any acute angle is believed to be useful to address the problems identified above, in one embodiment, the angle 1 may be about 22 degrees between the first longitudinal edge 101 and the transverse edge 103. In this embodiment, an angle 12 formed by the second longitudinal edge 102 with the transverse edge 103 may be an obtuse angle (an angle that is greater than 90 degrees).

In another embodiment, an angle 12 formed by the second longitudinal edge 102 with the transverse edge 103 may be an acute angle (not shown) and an angle 1 formed by the first longitudinal edge 101 with the transverse edge 103 may be an obtuse angle (not shown).

The pull seal strip 70 may be heat melted/sealed to the gasket 68 over the opening 72, thereby forming a border seal 81 comprising a pointed shape 84 adjacent the first transverse edge 78 and comprising an angled shape 82 adjacent to the second transverse edge 80 as shown in FIGS. 4 *a* and 5. The hot melt adheres the pull strip 70 to the gasket 68, forms the border seal 81 around the opening 72 and may function to seal the toner inside of the hopper during transport from the manufacturer to the end user. The pointed shape 84 facilitates the initial tearing away of the pull seal strip 70 from the gasket 68. Although the gasket 68's second transverse edge 80 is substantially perpendicular to the first longitudinal edge 74 and the second longitudinal edge 76, the border seal 81 adjacent to the second transverse edge 80 is angled shape 82 and may follow the transverse edge 103 of the pull seal strip 70 as shown in FIGS. 4 *a* and 5.

Figure 6:
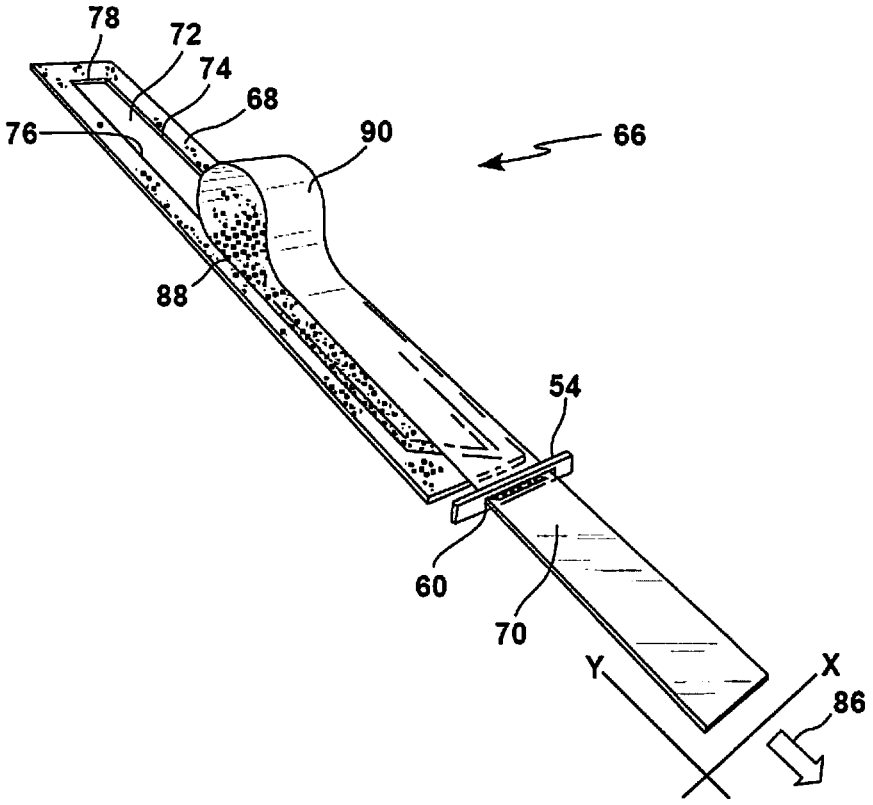
FIGS. 6-8 depict a perspective view of the FIG. 4 embodiment showing the seal strip being partially removed from the gasket.
Figure 7:
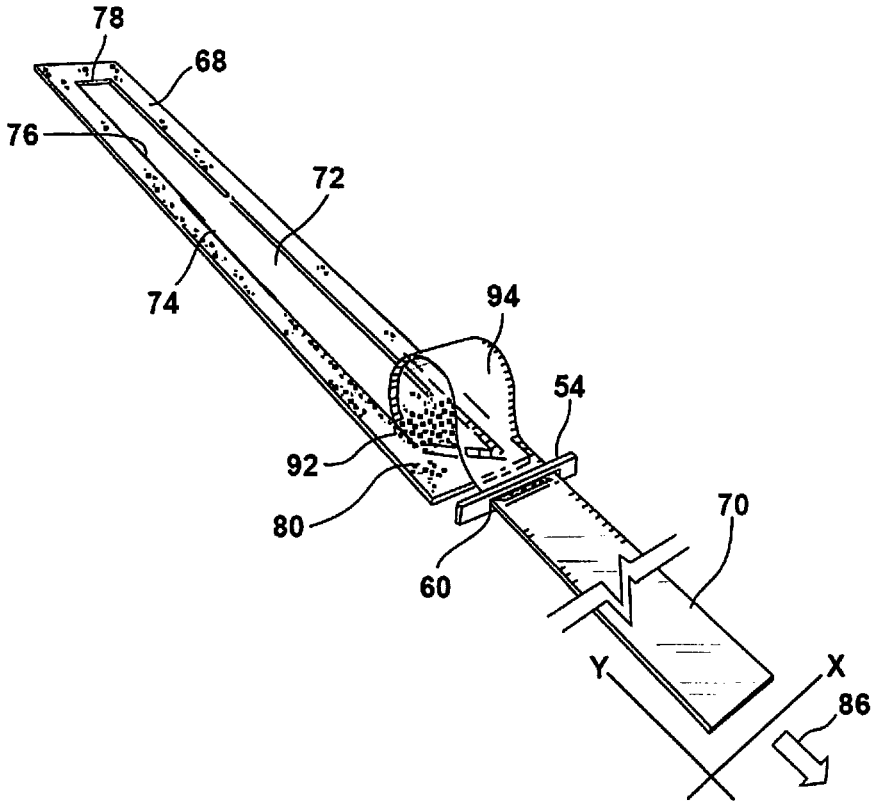

FIGS. 6-7 depicts how the pull strip 70 may be pulled in the direction of arrow 86 and thus off of the gasket 68. As shown in FIG. 6, the toner begins to build up along the top surface of the pull strip 70. The toner build up is shown at 88 and a loop of the pull strip 70 is shown at 90.

As the pull strip 70 gets close to being removed from the gasket 68 (as shown in FIG. 7), the excess toner build up 92 has increased in comparison to that shown in FIG. 6, and is positioned to jam the exit port 54 at opening 60. During pulling, the pull seal strip 70 forms a loop, shown at 94, above the gathering toner that has reached or is about to reach the position of the second transverse edge 80 of the gasket 68. The toner gathered as shown in FIG. 7 would likely cause a jam at the exit port 54, except for the presence and functioning of the border seal 81 that has an angled shape 82 that follows the transverse edge 103 of the pull strip 70.

Figure 8:
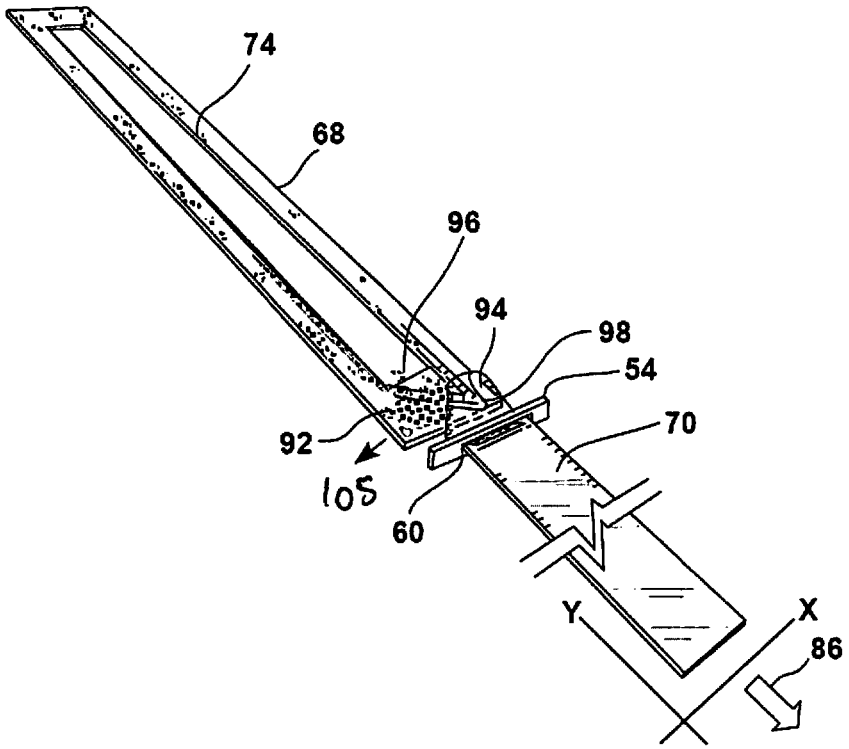

FIG. 8 illustrates the angled transverse edge 103 of the pull strip 70 providing a way for the excess toner to by-pass the exit port as the pull strip 70 is pulled off of the gasket 68. In this context the term "by-pass" means that the toner is permitted to be pushed to the side in the direction of arrow 105. In the presently disclosed embodiment, the toner is not formed into a plug or roll at the end of the gasket 68. After the pull strip 70 has been removed through the exit port 54, the toner build up 92 would be free to fall through the opening 72 into the hopper as shown by arrow 96.

In one embodiment, gasket seal 66 described above may also reduce jamming due to the gasket 68 lifting up off of the toner cartridge in some instances. The pull seal 70 as described and shown herein may work for its intended purpose for at least two reasons. The first reason relates to the gasket 68 lifting problem. That is the lifting force applied at any given instant to the gasket 68 as the pull seal 70 advances over the angled shape 82 is much less than is the lifting force applied to the edge 48 of the conventional gasket during removal of the pull seal in the conventional gasket seal. At any given instant when the lifting force is applied to lift the pull seal 70 and break the border seal 81 along the angled shape 82, the force applied is split into two directions or into two force vectors, one component in the direction opposite of arrow 105 and the other component perpendicular to that direction represented by arrow 86. Furthermore, the force applied is applied to a much smaller surface area of the seal strip and thus the total applied force is also less. Thus, at any instant significantly less force pulls the border seal 81 along the angled shape 82 at the end near the exit port than the pulling force applied when a conventional, right-angled gasket is used. The lifting force applied at any instant along this edge is minimized, thus, reducing the chance that the gasket can be pulled up and jammed at the exit port slot 54. The second reason is that as the pull strip is removed from the angled gasket, it provides a path for the excess toner on the top of the pull seal to be pushed in the direction represented by arrow 150, thus, reducing jamming at the exit port slot 54 due to the cigar effect.

Figure 9B:
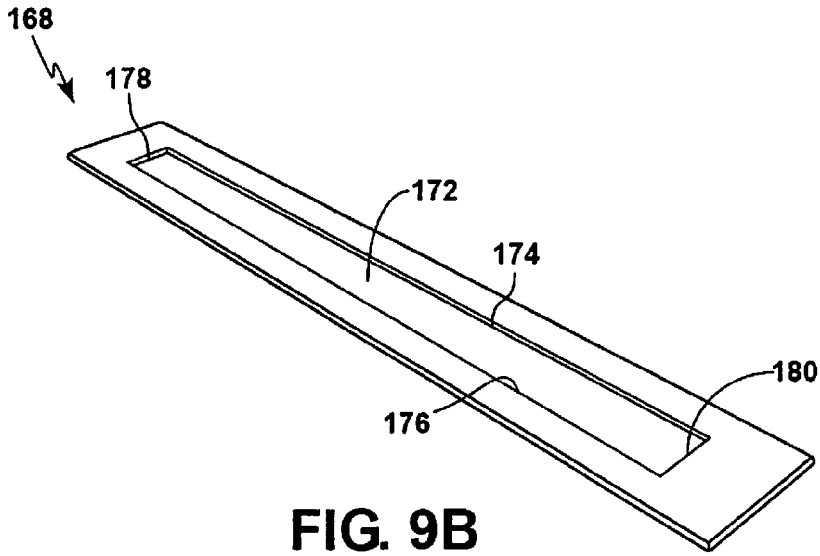
FIGS. 9 *a-c* depict another embodiment of a gasket seal according to the present disclosure.
Figure 9A:
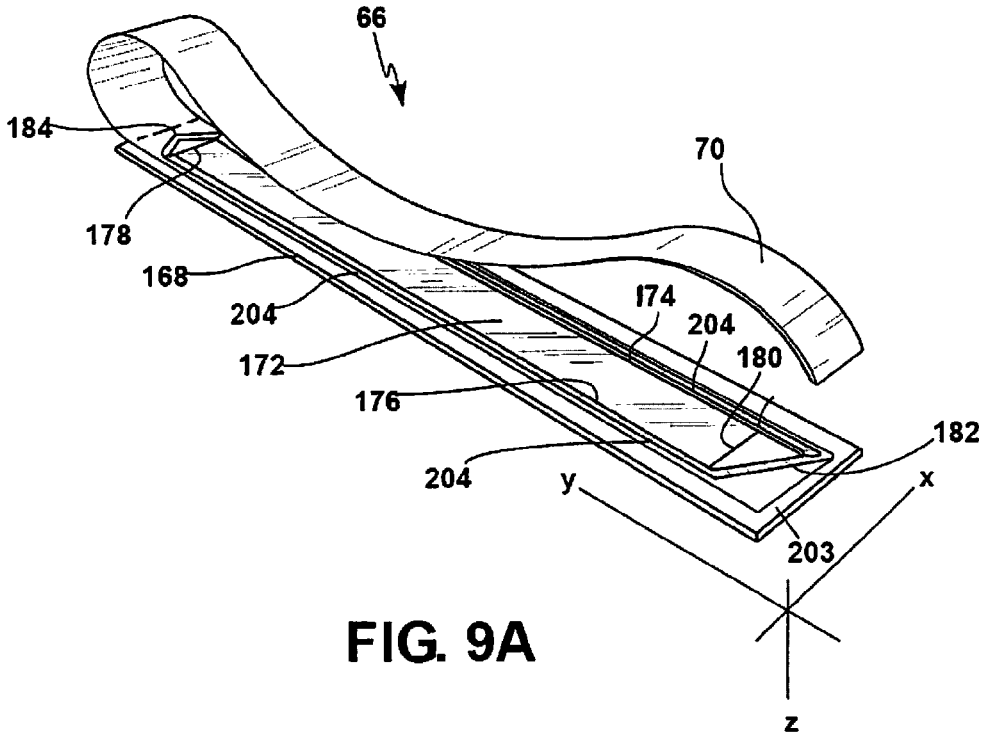
Figure 9C:
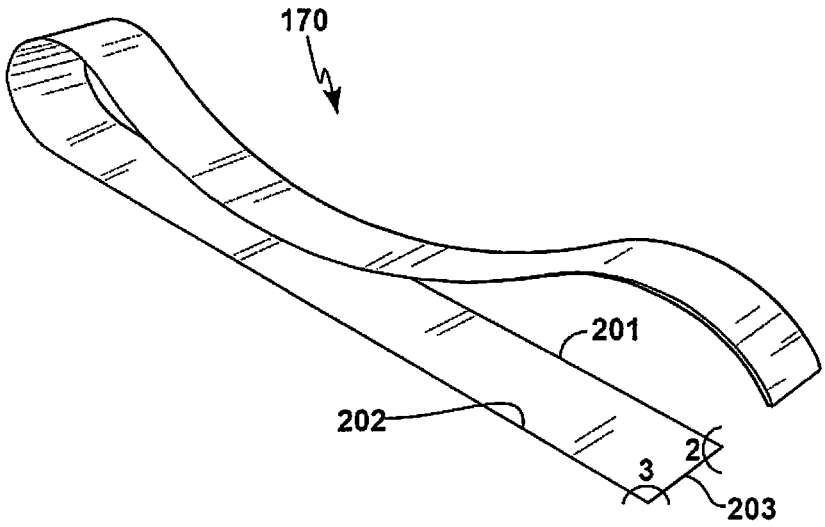
Figure 10:
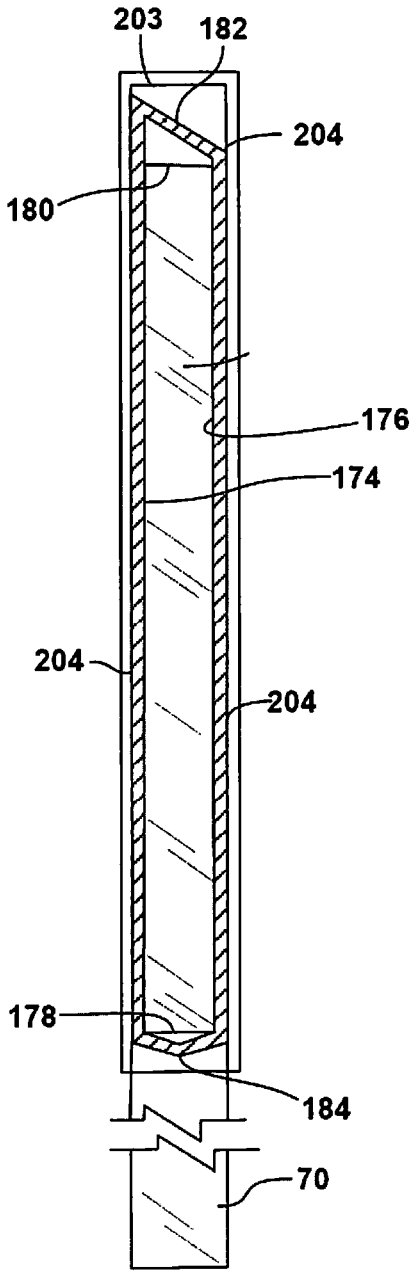
FIG. 10 depicts a top view of the embodiment shown in FIGS. 9 *a-c*.

FIGS. 9 *a-c* depict a perspective view of a gasket seal 166 according to another embodiment presently disclosed. The gasket seal 166 may comprise a gasket 168 (shown in FIGS. 9 *a-b*) and a pull seal strip 170 (shown in FIGS. 9 *a* and 9 *c*). In one embodiment, the gasket 168 may comprise foam material. The gasket 168 may define a substantially rectangular opening 172 (shown in FIGS. 9 *a-b*) to permit through flow of toner during printer operation. Gasket 168's sides or edges of the inner periphery include a first longitudinal edge 174, a second longitudinal edge 176, a first transverse edge 178 and a second transverse edge 180. The angles formed by the longitudinal edges 174 and 176 of the inner periphery with the second transverse edge 180 may be about 90 degrees. The pull seal strip 170 may comprise a first longitudinal edge 201, a second longitudinal edge 202, and a transverse edge 203. In one embodiment, the pull seal strip 170 may comprise a polyester film or metalized polyester film, often referred to as Mylar film.

In one embodiment, an angle 2 formed by the first longitudinal edge 201 with the transverse edge 203 may be about 90 degrees. An angle 3 formed by the second longitudinal edge 202 with the transverse edge 203 may also be about 90 degrees.

The pull seal strip 170 may be heat melted/sealed to the gasket 168 over the opening 172, thereby forming a border seal 204 comprising a pointed shape 184 adjacent the first transverse edge 178 and comprising an angled shape 182 adjacent to the second transverse edge 180 as shown in FIGS. 9 *a* and 10. The hot melt adheres the pull strip 170 to the gasket 168, forms the border seal 204 around the opening 172 and may function to seal the toner inside of the hopper during transport from the manufacturer to the end user. The pointed shape 184 facilitates the initial tearing away of the pull seal strip 170 from the gasket 168. Although the gasket 168's second transverse edge 80 is substantially perpendicular to the first longitudinal edge 174 and the second longitudinal edge 176, the border seal 84 adjacent to the second transverse edge 180 may have an angled shape 182 with respect to the second transverse edge 180 as shown in FIGS. 9 *a* and 10. Furthermore, the border seal 84 adjacent to the second transverse edge 180 may also have an angled shape 182 with respect to the transverse edge 203 of the pull seal strip 170 as shown in FIGS. 9 *a* and 10. The angled shape 182 facilitates the final tearing away of the pull seal strip 170 from the gasket 168.

In one embodiment, gasket seal 166 described above may reduce jamming due to the gasket 168 lifting up off of the toner cartridge in some instances. The lifting force applied at any given instant to the gasket 168 as the pull seal 170 advances over the angled shape 182 is much less than is the lifting force applied to the edge 48 of the conventional gasket during removal of the pull seal in the conventional gasket seal. At any given instant when the lifting force is applied to lift the pull seal 170 and break the border seal 204 along the angled shape 182, the force applied is split into two directions or into two force vectors. Furthermore, the force applied is applied to a much smaller surface area of the seal strip and thus the total applied force is also less. Thus, at any instant significantly less force pulls the border seal 204 along the angled shape 182 at the end near the exit port than the pulling force applied when a conventional gasket is used. The lifting force applied at any instant along this edge is minimized, thus, reducing the chance that the gasket 168 can be pulled up and jammed at the exit port slot.

Figure 11B:
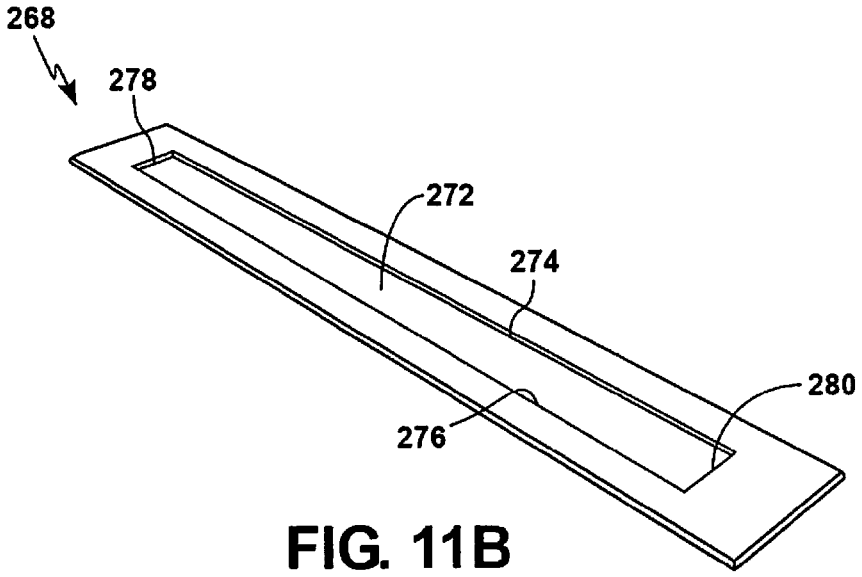
FIGS. 11 *a-c* depict another embodiment of a gasket seal according to the present disclosure.
Figure 11A:
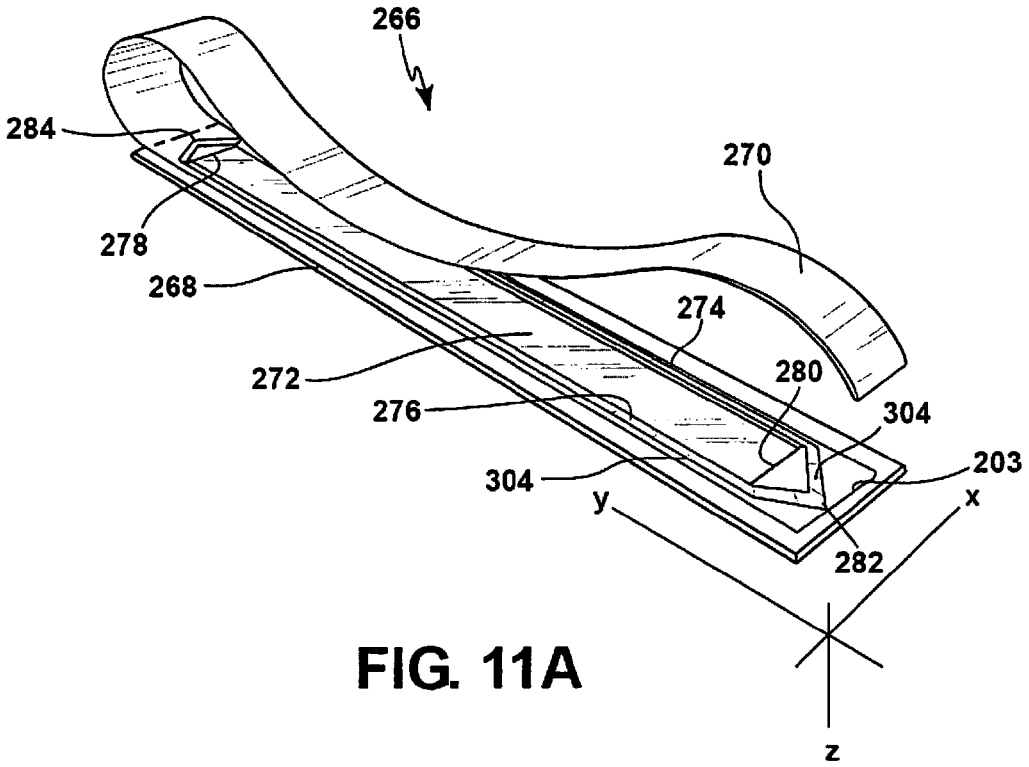
Figure 11C:
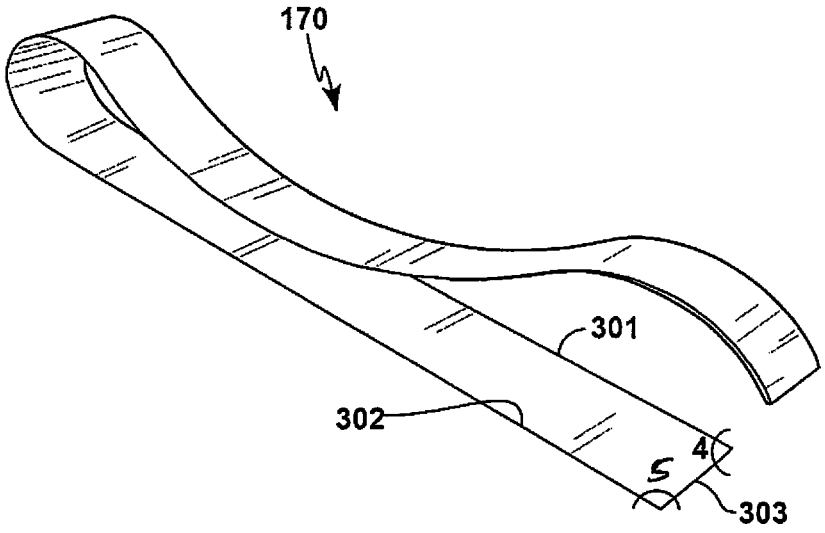
Figure 12:
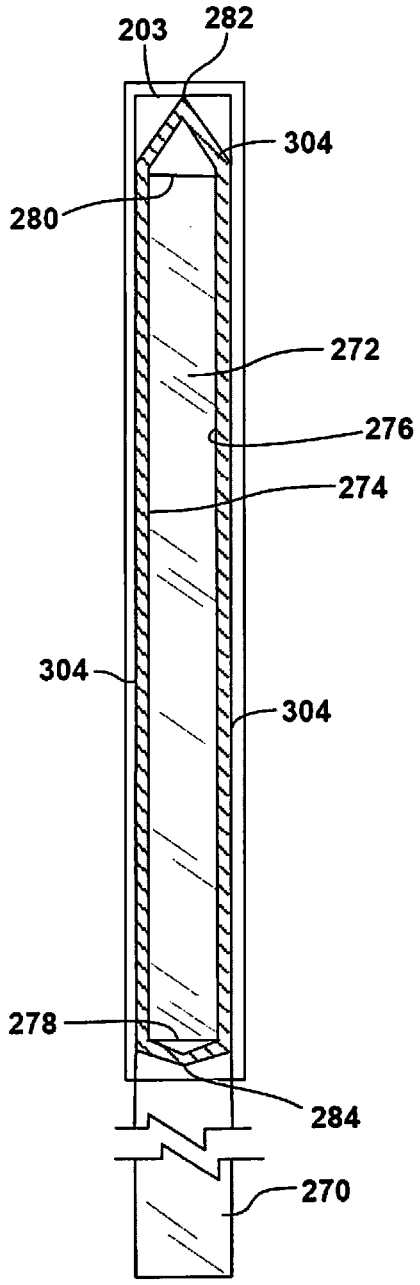
FIG. 12 depicts a top view of the embodiment shown in FIGS. 11 *a-c*.

FIGS. 11 *a-c* depict a perspective view of a gasket seal 266 according to another embodiment presently disclosed. The gasket seal 266 may comprise a gasket 268 (shown in FIGS. 11 *a-b*) and a pull seal strip 270 (shown in FIGS. 11 *a* and 11 *c*). In one embodiment, the gasket 268 may comprise foam material. The gasket 268 may define a substantially rectangular opening 272 (shown in FIGS. 11 *a-b*) to permit through flow of toner during printer operation. Gasket 268's sides or edges of the inner periphery comprise a first longitudinal edge 274, a second longitudinal edge 276, a first transverse edge 278 and a second transverse edge 280. The angles formed by the longitudinal edges 274 and 276 of the inner periphery with the second transverse edge 280 may be about 90 degrees. The pull seal strip 270 may comprise a first longitudinal edge 301, a second longitudinal edge 302, and a transverse edge 303. In one embodiment, the pull seal strip 270 may comprise a polyester film or metalized polyester film, often referred to as Mylar film.

In one embodiment, an angle 4 formed by the first longitudinal edge 301 with the transverse edge 303 may be about 90 degrees. An angle 5 formed by the second longitudinal edge 302 with the transverse edge 303 may be about 90 degrees.

The pull seal strip 270 may be heat melted/sealed to the gasket 268 over the opening 272, thereby forming a border seal 304 having a pointed shape 284 adjacent the first transverse edge 278 and having another pointed shape 282 adjacent to the second transverse edge 280 as shown in FIGS. 11 *a* and 12. The hot melt adheres the pull strip 270 to the gasket 268, forms the border seal 304 around the opening 272 and may function to seal the toner inside of the hopper during transport from the manufacturer to the end user. The pointed shape 284 facilitates the initial tearing away of the pull seal strip 270 from the gasket 268. Although the gasket 268's second transverse edge 280 is substantially perpendicular to the first longitudinal edge 274 and the second longitudinal edge 276, the border seal 304 adjacent to the second transverse edge 280 may have a pointed shape 282 with respect to the second transverse edge 280 as shown in FIGS. 11 *a* and 12. Furthermore, the border seal 304 adjacent to the second transverse edge 280 may also have a pointed shape 282 with respect to the transverse edge 303 of the pull seal strip 270 as shown in FIGS. 11 *a* and 12. The pointed shape 282 of the border seal 304 facilitates the final tearing away of the pull seal strip 270 from the gasket 268.

In one embodiment, gasket seal 266 described above may reduce jamming due to the gasket 268 lifting up off of the toner cartridge in some instances. The lifting force applied at any given instant to the gasket 268 as the pull seal 270 advances over the angled shape 282 is much less than is the lifting force applied to the edge 48 of the conventional gasket during removal of the pull seal in the conventional gasket seal. At any given instant when the lifting force is applied to lift the pull seal 270 and break the border seal 304 along the pointed shape 282, the force applied is split into multiple directions or into multiple force vectors. Furthermore, the force applied is applied to a much smaller surface area of the seal strip and thus the total applied force is also less. Thus, at any instant significantly less force pulls the border seal 304 along the pointed shape 282 at the end near the exit port than the pulling force applied when a conventional gasket is used. The lifting force applied at any instant along this edge is minimized, thus, reducing the chance that the gasket 268 can be pulled up and jammed at the exit port slot.

Figure 13B:
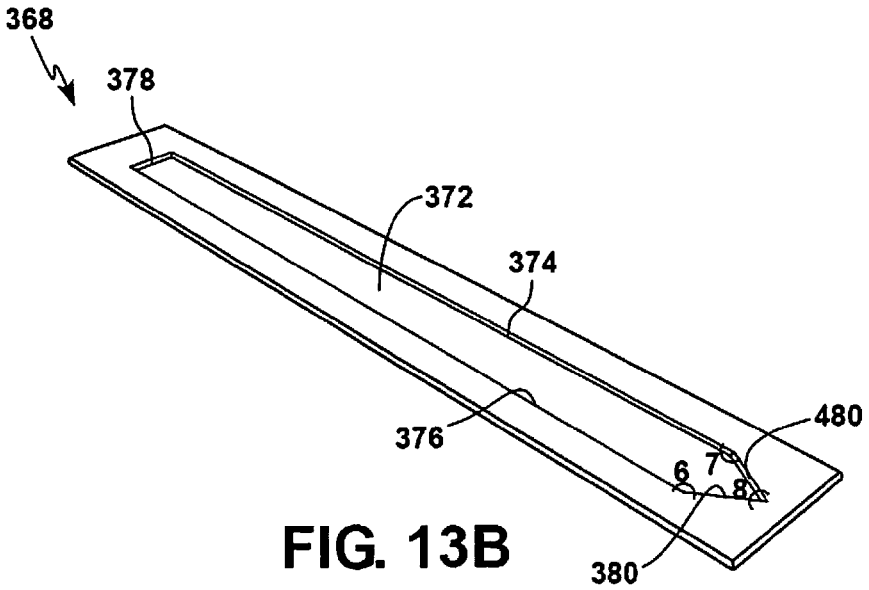
FIGS. 13 *a-c* depict another embodiment of a gasket seal according to the present disclosure.
Figure 13A:
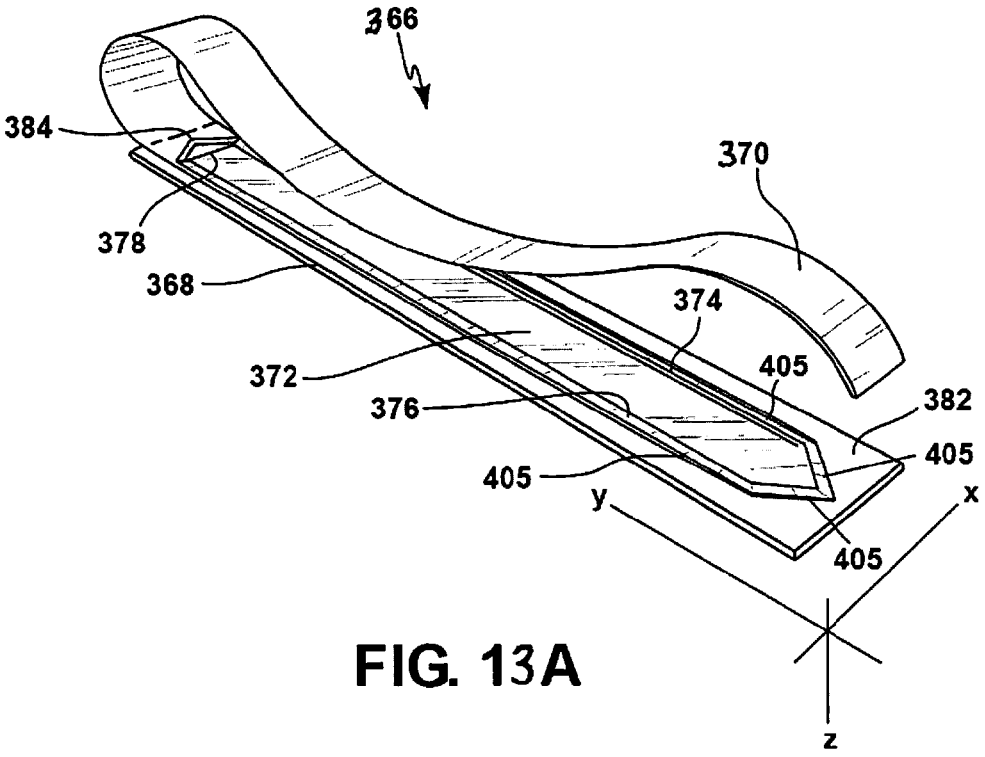
Figure 13C:
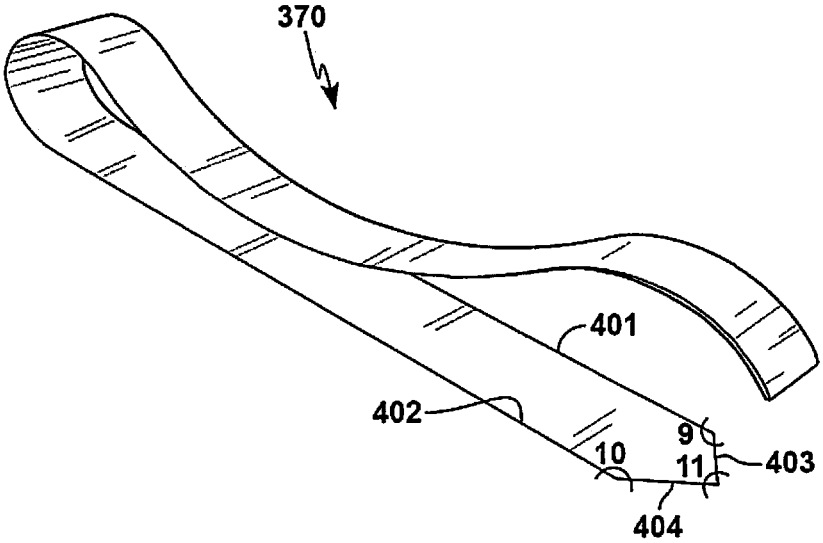
Figure 14:
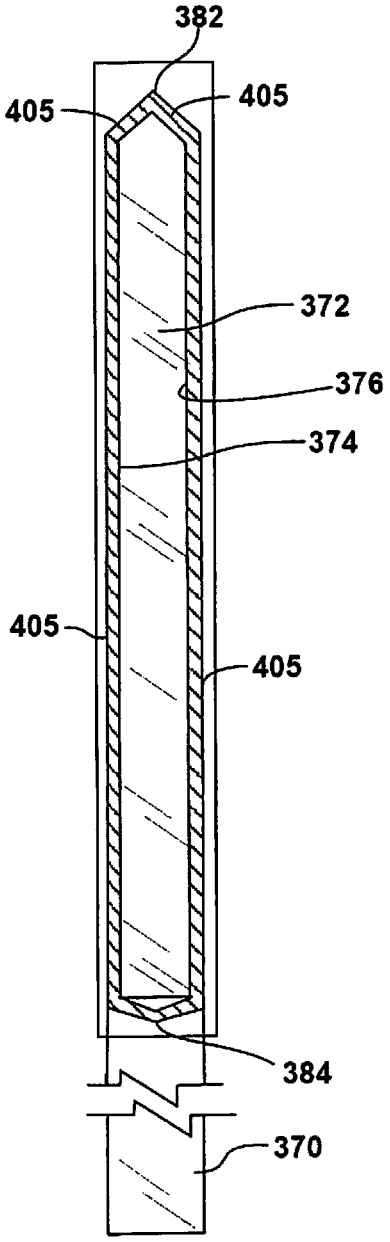
FIG. 14 depicts a top view of the embodiment shown in FIGS. 13 *a-c*.

FIGS. 13 *a-c* depict a perspective view of a gasket seal 366 according to another embodiment presently disclosed. The gasket seal 366 may comprise a gasket 368 (shown in FIGS. 13 *a-b*) and a pull seal strip 370 (shown in FIGS. 13 *a* and 13 *c*). In one embodiment, the gasket 368 may comprise foam material. The gasket 368 may define an opening 272 (shown in FIGS. 11 *a-b*) to permit through flow of toner during printer operation. Gasket 368's sides or edges of the inner periphery comprise a first longitudinal edge 374, a second longitudinal edge 376, a first transverse edge 378, a second transverse edge 380 and a third transverse edge 480. In an embodiment, the angle 6 formed by the longitudinal edge 376 with the second transverse edge 380 may be an obtuse angle (an angle that is greater than 90 degrees). In an embodiment, the angle 7 formed by the longitudinal edge 374 with the third transverse edge 480 may also be an obtuse angle. In another embodiment, the angle 8 formed by the second transverse edge 380 with the third transverse edge 480 may be less than 90 degrees. In another embodiment, the angle 8 formed by the second transverse edge 380 with the third transverse edge 480 may be an acute angel. The pull seal strip 370 may comprise a first longitudinal edge 401, a second longitudinal edge 402, a first transverse edge 403 and a second transverse edge 404. In one embodiment, the pull seal strip 370 may comprise a polyester film or metalized polyester film, often referred to as Mylar film.

In an embodiment, an angle 9 formed by the first longitudinal edge 401 with the first transverse edge 403 may be an obtuse angle. In an embodiment, an angle 10 formed by the second longitudinal edge 402 with the second transverse edge 404 may be an obtuse angle. In an embodiment, an angle 11 formed by the first transverse edge 403 with the second transverse edge 404 may be less than 90 degrees. In another embodiment, the angle 11 formed by the first transverse edge 403 with the second transverse edge 404 may be an acute angle.

The pull seal strip 370 may be heat melted/sealed over the opening 372, thereby forming a border seal 405 having a pointed shape 384 adjacent the first transverse edge 378 and having another pointed shape 382 adjacent to the second transverse edge 380 as shown in FIGS. 13 *a* and 14. The hot melt adheres the pull strip 370 to the gasket 368, forms the border seal 405 around the opening 372 and may function to seal the toner inside of the hopper during transport from the manufacturer to the end user. The pointed shape 384 facilitates the initial tearing away of the pull seal strip 370 from the gasket 368. The pointed shape 382 facilitates the final tearing away of the pull seal strip 370 from the gasket 368.

In one embodiment, gasket seal 366 described above may also reduce jamming due to the gasket 368 lifting up off of the toner cartridge in some instances. The pull seal 370 as described and shown herein may work for its intended purpose for at least two reasons. The first reason relates to the gasket 368 lifting problem. That is the lifting force applied at any given instant to the gasket 368 as the pull seal 370 advances over the angled shape 382 is much less than is the lifting force applied to the edge 48 of the conventional gasket during removal of the pull seal in the conventional gasket seal. At any given instant when the lifting force is applied to lift the pull seal 370 and break the border seal 405 along the pointed shape 382, the force applied is split into multiple directions or into multiple force vectors. Furthermore, the force applied is applied to a much smaller surface area of the seal strip and thus the total applied force is also less. Thus, at any instant significantly less force pulls the border seal 405 along the pointed shape 382 at the end near the exit port than the pulling force applied when a conventional, right-angled gasket is used. The lifting force applied at any instant along this edge is minimized, thus, reducing the chance that the gasket 368 can be pulled up and jammed at the exit port slot. The second reason is that as the pull seal 370 is removed from the gasket 368, it provides a path for the excess toner on the top of the pull seal to be pushed to the sides, thus, reducing jamming at the exit port slot due to the cigar effect.

Although the above embodiments reference a remanufactured printer cartridges, it is to be understood that presently disclosed embodiments should not be limited to the remanufactured printer cartridges. Presently disclosed embodiments may also be applied to seal OEM cartridges.

Although the above embodiments reference printer cartridges, it is to be understood that presently disclosed embodiments should not be limited to printer cartridges. Presently disclosed embodiments may be applied to seal any opening defined by a housing.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . . "

What is claimed is:

1. A gasket seal comprising:

a gasket defining an opening, and;

a seal strip removably coupled with the gasket, the seal strip comprising:

a fixed end secured to the gasket;

a free end opposite the fixed end, the free end being pulled during removal of the seal strip;

a first seal longitudinal edge;

a second seal longitudinal edge;

a first seal transverse edge adjacent the fixed end, wherein the first seal transverse edge forms an obtuse angle with the first seal longitudinal edge; and a second seal transverse edge adjacent the fixed end, wherein the second seal transverse edge forms another obtuse angle with the second seal longitudinal edge.

2. The gasket seal of claim 1, wherein the first seal transverse edge forms an acute angle with the second seal transverse edge.

3. The gasket seal of claim 1, wherein the gasket includes a first gasket longitudinal edge, a second gasket longitudinal edge, a first gasket transverse edge, and a second gasket transverse edge, wherein the first gasket transverse edge forms a first gasket edge obtuse angle with the first gasket longitudinal edge, and wherein the second gasket transverse edge forms a second gasket edge obtuse angle with the second gasket longitudinal edge.

4. The gasket seal of claim 3, wherein the first gasket transverse edge forms a gasket edge acute angle with the second gasket transverse edge.

5. A gasket seal comprising:

a gasket defining an opening comprising:

a first gasket longitudinal edge;

a second gasket longitudinal edge;

a gasket transverse edge, wherein the gasket transverse edge forms a 90 degree angle with the first gasket longitudinal edge and the second gasket longitudinal edge;

a seal strip comprising:

a first seal longitudinal edge;

a second seal longitudinal edge; and a seal transverse edge, wherein the seal transverse edge forms a 90 degree angle with the first longitudinal edge; wherein the seal transverse edge forms a 90 degree angle with the second seal longitudinal edge; and a gasket sealing border removably adhering the seal strip with the gasket, the gasket sealing border extending around the gasket opening and adhering the seal transverse edge to the gasket adjacent to a gasket exit port end;

wherein the gasket sealing border forms a first border longitudinal edge; a second border longitudinal edge; and a border transverse edge;

wherein the border transverse edge forms an acute angle with the first border longitudinal edge;

wherein the border transverse edge forms an obtuse angle with the second border longitudinal edge.

6. A gasket seal comprising:

a gasket defining an opening comprising:

a first gasket longitudinal edge;

a second gasket longitudinal edge;

a gasket transverse edge, wherein the gasket transverse edge forms a 90 degree angle with the first gasket longitudinal edge and the second gasket longitudinal edge;

a seal strip comprising:

a first seal longitudinal edge;

a second seal longitudinal edge; and a seal transverse edge, wherein the seal transverse edge forms a 90 degree angle with the first longitudinal edge; wherein the seal transverse edge forms a 90 degree angle with the second seal longitudinal edge; and a gasket sealing border removably adhering the seal strip with the gasket, the gasket sealing border extending substantially around the gasket opening and adhering the seal transverse edge to the gasket adjacent to a gasket exit port end;

wherein the gasket sealing border forms a first border longitudinal edge; a second border longitudinal edge; and a border transverse edge;

wherein the border transverse edge forms an obtuse angle with the first border longitudinal edge;

wherein the border transverse edge forms another obtuse angle with the second border longitudinal edge.

* * * * *

UNITED STATES PATENT AND TRADEMARK OFFICE

CERTIFICATE OF CORRECTION

PATENT NO. : 9,128,414 B2
APPLICATION NO. : 14/214540
DATED : September 8, 2015
INVENTOR(S) : Sagie Shanun and Alexander Krayner It is certified that error appears in the above-identified patent and that said Letters Patent is hereby corrected as shown below:

In the specification,
Column 2, line 15, "when is it is curled up" should be changed to --when it is curled up--.
Column 5, line 46, "FIGS. 6-7 depicts" should be changed to --FIGS. 6-7 depict--.
Column 8, line 48, "acute angel" should be changed to --acute angle--.

Signed and Sealed this
Ninth Day of February, 2016

Michelle K. Lee

Michelle K. Lee
*Director of the United States Patent and Trademark Office*